US009099768B2

(12) United States Patent
Jeon et al.

(10) Patent No.: US 9,099,768 B2
(45) Date of Patent: Aug. 4, 2015

(54) ANTENNA DEVICE

(75) Inventors: Seung-gil Jeon, Seoul (KR); Joong-hee Lee, Seongnam-si (KR); Tae-sik Yang, Suwon-si (KR); Jae-young Chung, Seoul (KR); Jung-hwan Choi, Yonging-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 224 days.

(21) Appl. No.: 13/594,256

(22) Filed: Aug. 24, 2012

(65) Prior Publication Data

US 2013/0120220 A1 May 16, 2013

Related U.S. Application Data

(60) Provisional application No. 61/559,334, filed on Nov. 14, 2011.

(30) Foreign Application Priority Data

Dec. 28, 2011 (KR) ..... 10-2011-0145015

(51) Int. Cl.
*H01Q 7/08* (2006.01)
*H01Q 1/36* (2006.01)

(52) U.S. Cl.
CPC . *H01Q 7/08* (2013.01); *H01Q 1/362* (2013.01)

(58) Field of Classification Search
CPC ..... H01Q 7/08
USPC ..... 343/895
See application file for complete search history.

(56) References Cited

U.S. PATENT DOCUMENTS

| | | | | |
|---|---|---|---|---|
| 2004/0037597 | A1* | 2/2004 | Haseba et al. | 399/328 |
| 2008/0165073 | A1* | 7/2008 | Chou | 343/793 |
| 2009/0153418 | A1* | 6/2009 | Park | 343/702 |

FOREIGN PATENT DOCUMENTS

| | | | |
|---|---|---|---|
| JP | 2001223518 | A | 8/2001 |
| KR | 2020090001941 | U | 3/2009 |
| KR | 2020090003579 | U | 4/2009 |
| KR | 1020090063094 | A | 6/2009 |
| KR | 1020090091945 | A | 8/2009 |
| KR | 1020100044551 | A | 4/2010 |
| KR | 1020110094729 | A | 8/2011 |

* cited by examiner

*Primary Examiner* — Dameon E Levi
*Assistant Examiner* — Andrea Lindgren Baltzell
(74) *Attorney, Agent, or Firm* — Sughrue Mion, PLLC

(57) ABSTRACT

An antenna device includes: a feeding rod unit connected to a feeding unit, in which a radio signal is applied to be sent and received to the feeding unit; an end rod unit, disposed at the end of the antenna device, and spaced apart from the feeding rod unit; at least one intermediate rod unit, interposed between the feeding rod unit and the end rod unit; a first helical unit, interposed between the feeding rod unit and the at least one intermediate rod unit; and a second helical unit, interposed between the intermediate rod unit and the end rod unit.

8 Claims, 5 Drawing Sheets

ANTENNA DEVICE

CROSS-REFERENCE TO RELATED PATENT APPLICATION

This application claims the benefit of Korean Patent Application No. 10-2011-0145015, filed on Dec. 28, 2011, in the Korean Intellectual Property Office, and U.S. Patent Application No. 61/559,334, filed on Nov. 14, 2011, in the U.S. Patent Office, the disclosure of which is incorporated herein in its entirety by reference.

BACKGROUND

1. Field

Embodiments relate to an antenna device in which a radio communication device may receive a radio signal.

2. Description of the Related Art

Antenna devices for radio communication have been developed in a related art to be applied to portable terminals to send/receive radio signals.

An antenna device of the related art may be classified into an internal antenna and an external antenna according to whether the antenna device is accommodated in a terminal housing. Examples of the internal antenna may include a loop antenna, an inverted-L antenna, a planar inverted-F antenna (PIFA), etc. A monopole-type antenna or a rod-type antenna is mainly used as the external antenna.

Regarding an antenna of the related art, a physical length is determined by an electrical resonance length, which varies according to an operating frequency. Also, the physical length of the antenna may vary by a specific situation or a complicated structure. However, a range, in which the physical length of the antenna varies, is narrow. In particular, the monopole-type antenna, which is mainly used as the external antenna, has a simple shape. Thus, it is difficult to make the monopole-type antenna small.

A terrestrial digital multimedia broadcasting (DMB) has been used in the related art. A portable terminal market adds a broadcasting signal receiving function to a terminal in the related art. However, a frequency band used in a terrestrial DMB service is allocated in a range between about 180 MHz to about 186 MHz or between about 204 MHz to about 210 MHz. This frequency band is different from a frequency band of a mobile communication service used in the related art. Thus, it is difficult to provide the terrestrial DMB service through a related art portable terminal. In other words, an antenna device installed in the related art portable terminal is set to operate in a frequency band equal to or more than about 800 MHz. Thus, the antenna device of the related art is not proper for the terrestrial DMB service. In the antenna device proper for a frequency band used in the terrestrial DMB service, a length, protrudes out of a terminal, is as long as about 37 cm. This length corresponds to a quarter-wave, based on a frequency band of 200 MHz. In a related art, there have been attempts to reduce a protruding length of an antenna up to 20 cm by inserting a helical coil into the antenna. However, in view of a related art portable terminal having a major axis of about 10 cm, aesthetics and portability is greatly decreased in an antenna with a protruding length of 20 cm. Further, a complicated folding structure for accommodating the protruding length of 20 cm, in an apparatus of 10 cm, should be accomplished.

SUMMARY

Embodiments provide an antenna device of a portable terminal for receiving a radio signal for broadcasting, wherein the antenna device has a structure in which a protruding length is reduced.

According to an aspect of an exemplary embodiment, there is provided an antenna device including: a feeding rod unit connected to a feeding unit, in which a radio signal is sent and received to the feeding unit; an end rod unit, disposed at the end of the antenna device, and spaced apart from the feeding rod unit; at least one intermediate rod unit, interposed between the feeding rod unit and the end rod unit; a first helical unit, interposed between the feeding rod unit and the at least one intermediate rod unit; and a second helical unit, interposed between the intermediate rod unit and the end rod unit.

Cross-section diameters of each rod shape included in the feeding rod unit, the at least one intermediate rod unit, and the end rod unit are the same.

The first helical unit may be disposed adjacent to the feeding rod unit.

When a central wavelength of the radio signal to be sent and received is $\lambda$, an entire length of the antenna device may be about $\lambda/16$.

The antenna device may be designed to send and receive a radio signal for digital multimedia broadcasting (DMB) or digital video broadcasting (DVB).

When an entire length of the antenna device is L, a distance between a beginning of the antenna device 100 and an end of the first helical unit may be less than L/2.

Each of the first and second helical units may include a bobbin and a coil, surrounding the bobbin, wherein the bobbin is formed of a mixture of a magnetic material and plastic.

The magnetic material may have a relative permeability equal to or more than 4, and a permeability loss equal to or less than 0.5 at a frequency equal to or higher than 2 GHz.

The magnetic material may include a compound represented by Equation 1 below, $$Ba_2Co_{2-x-y-z}Zn_xCu_yMn_zFe_{12}O_{22} \quad (1)$$

wherein, x is in a range between about 0.5 and about 0.9, y in a range between about 0 and about 0.4, z in a range between about 0 and about 0.4, and x+y+z is in a range between about 0.5 and about 1.2.

The plastic may include any one of polycarbonate (PC), polyphenylene oxide (PPO), polycarbonate/acrylonitrile-butadiene-styrene (PC/ABS), or modified polyphenylene ether (mPPE).

According to another aspect of an exemplary embodiment, there is provided a radio communication terminal including the antenna device.

A major axis of the radio communication terminal may be longer than a major axis of the antenna device.

According to a further aspect of an exemplary embodiment, there is provided an antenna device including a feeding rod unit connected to a feeding unit, the feeding unit disposed on the feeding rod unit, and the feeding unit sending and receiving a radio signal; an end rod unit disposed at an end of the antenna device opposite to an end of the antenna device that the feeding rod unit is disposed; at least one intermediate rod unit between the feeding rod unit and the end unit; and at least one helical unit between the feeding rod unit and the end unit.

At least one intermediate rod unit and the at least one helical unit may be alternately arranged between the feeding rod unit and the end unit.

The feeding rod unit, the end rod unit, and the at least one intermediate rod unit may each have a same rod diameter cross-section.

The at least one intermediate rod unit may comprise a first intermediate rod and a second intermediate rod.

The at least one helical unit may comprise a first helical unit, a second helical unit, and a third helical unit.

The first helical unit may be disposed adjacent to the feeding rod unit and the third helical unit is disposed adjacent to the end rod unit.

An entire length of the antenna device may be about λ/16.

A radio communication terminal may comprise the antenna device, in which a major axis of the radio communication terminal is longer than a major axis of the antenna device.

BRIEF DESCRIPTION OF THE DRAWINGS

The above and other features and advantages of embodiments will become more apparent by describing in detail exemplary embodiments thereof with reference to the attached drawings in which.

DETAILED DESCRIPTION

Figure 1:
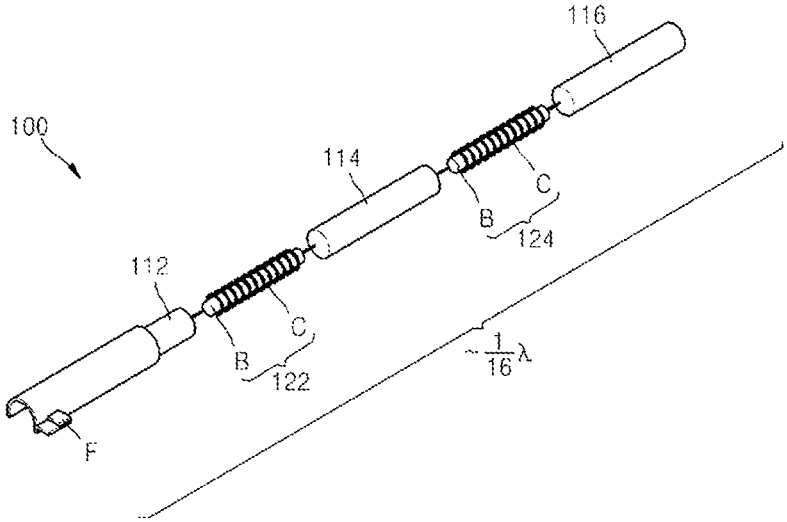
FIG. 1 is a schematic perspective view of an antenna device, according to an embodiment.

Hereinafter, embodiments will be described in detail by explaining exemplary embodiments with reference to the attached drawings. The same reference numerals in the drawings denote the same element. In the drawings, the thicknesses of layers and regions are exaggerated for clarity.

FIG. 1 is a schematic perspective view of an antenna device, according to an embodiment.

The antenna device 100 of the current embodiment includes a plurality of rod portions and a plurality of helical portions. A length of the antenna device 100 may be reduced by properly interposing the helical portions between the rod portions.

The antenna device 100 includes a feeding rod unit 112 connected to a feeding unit F, in which a radio signal to be sent/received is applied. The antenna device 100 includes an end rod unit 116 disposed at the end of the antenna device 100, to be spaced from the feeding rod unit 112. The antenna device 100 also includes an intermediate rod unit 114 interposed between the feeding rod unit 112 and the end rod unit 116, a first helical unit 122 interposed between the feeding rod unit 112 and the intermediate rod unit 114, and a second helical unit 124 interposed between the intermediate rod unit 114 and the end rod unit 116.

The feeding rod unit 112 includes a mechanism to be installed in an apparatus requiring the antenna device 100. The feeding unit 112 also includes the feeding unit F, for feeding a signal to be sent and received. The feeding unit F is disposed on the mechanism. The feeing rod unit 112 also includes an end of the feeding rod unit 112, which has a rod shape.

The end rod unit 116 is disposed at the end of the antenna device 100. The end rod unit 116 has a rod shape to reduce a length of the antenna device 100. The end rod unit 116 disposes the first and second helical units 122 and 124 in the antenna device 100. If the first and second helical units 122 and 124 are disposed at the end of the antenna device 100, the antenna device 100 will not have good performance.

The intermediate rod unit 114 allows two or more helical units to be disposed at a predetermined interval in the antenna device 100. Although only one intermediate rod unit 114 is shown in FIG. 1, two or more intermediate rod units 114 may be disposed according to the number of helical units.

The feeding rod unit 112, the intermediate rod unit 114, and the end rod unit 116 are formed of a conductive material. The diameters of the cross-sections of each rod shape included in the feeding rod unit 112, the intermediate rod unit 114, and the end rod unit 116 may be the same.

Each of the first and second helical units 122 and 124 includes a bobbin B and a coil C surrounding the bobbin B. The bobbin B may be formed of a mixture of a magnetic material and plastic. The magnetic material may have a low permeability loss at high frequency. For example, the magnetic material has a relative permeability equal to or more than 4 at frequency equal to or higher than 2 GHz and a permeability loss equal to or less than 0.5.

When a magnetic material having permeability is used in an antenna, a bandwidth of a frequency band can be broadened without increasing a size of the antenna. However, using the magnetic material may be hindered because the efficiency of the antenna is decreased. The efficiency of the antenna is decreased due to a general magnetic material having a permeability loss at high frequencies. In the current embodiment, by using a mixture of a magnetic material having a low permeability loss at high frequency and plastic as a bobbin, a diameter of the antenna device 100 may not be increased while performance of the antenna device 100 is kept constant.

The magnetic material may include a compound represented by Equation 1 below, $$Ba_2Co_{2-x-y-z}Zn_xCu_yMn_zFe_{12}O_{22} \quad (1)$$

wherein, x is in a range between about 0.5 and about 0.9, y in a range between about 0 and about 0.4, z in a range between about 0 and about 0.4, and x+y+z is in a range between about 0.5 and about 1.2.

The plastic, mixed with the magnetic material of the bobbin B, may be polycarbonate (PC), polyphenylene oxide (PPO), polycarbonate/acrylonitrile-butadiene-styrene (PC/ABS), or modified polyphenylene ether (mPPE).

The antenna device 100 may be designed to send/receive a radio signal for DMB or digital video broadcasting (DVB). When a central wavelength of the radio signal to be sent/received is λ, an entire length of the antenna device 100 may be about λ/16.

Hereinafter, the performances of the antenna device 100 are performed by the above-described process with a length as short as λ/16, which will be described with reference to FIGS. 2 to 4.

Figure 2:
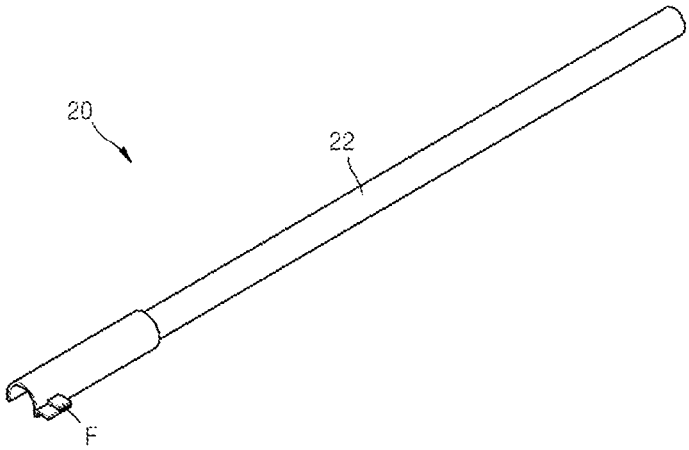
FIG. 2 is a schematic perspective view of an antenna device, according to a comparative example.

FIG. 2 is a schematic perspective view of an antenna device 20, according to a comparative example.

The rod-type antenna device 20 does not include a helical unit and has a rod shape. When a length of the antenna device 20 is λ/4, the antenna device 20 may have good performance for sending/receiving a signal, and the antenna device 20 having a length of λ/16 shows an electromagnetic field that is not proper for being used as an antenna. In this case, throughout a section of the antenna, an electric field is uniform and a magnetic field is low. Such an electromagnetic field distribution corresponds to a case of an ideal monopole or a short monopole.

The embodiments are based on the fact that an electromagnetic potential may be encased in a section of an antenna when a helical unit is disposed in a proper position of a rod-type antenna. Variations in electromagnetic field potential may be obtained through a computer simulation by disposing the helical unit close to a feeding unit of the antenna, in the middle of the antenna, and at the end of the antenna.

Figure 3:
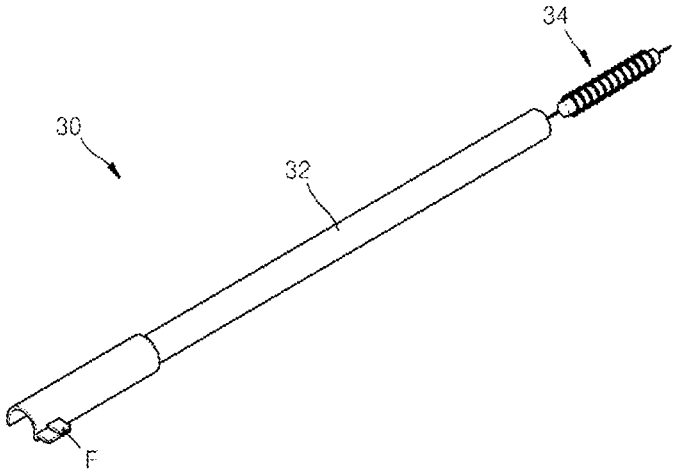
FIG. 3 is a schematic perspective view of an antenna device, according to another comparative example.

FIG. 3 is a schematic perspective view of an antenna device 30, according to another comparative example. FIG. 4 is a schematic perspective view of an antenna device 40, according to another comparative example.

The antenna device 30 of FIG. 3 includes a helical unit 34 at the end. In other words, the antenna device 30 includes a feeding rod unit 32, that is formed long, and a helical unit 34. The antenna device 40 of FIG. 4 has a structure in which a helical unit 44 is disposed close to a feeding unit F. The antenna device 40 includes a feeding rod unit 42, the helical unit 44, and a rod unit 46.

When entire lengths of the antenna devices 30 and 40 are λ/16, distribution of an electromagnetic field through a computer simulation occurs as follows. The antenna device 30 of FIG. 3, in which the helical unit 34 is disposed at the end of the antenna device 30, rarely shows an increase in electromagnetic potential compared to the antenna device 20 of FIG. 2. The antenna device 20 of FIG. 2 has a rod shape. On the other hand, the antenna device 40 of FIG. 4, in which the helical unit 44 is disposed close to the feeding unit F as much as possible, shows an increase in electromagnetic potential. Although not shown in the drawing, in an antenna device according to a comparative example in which a helical unit is disposed in the middle of the antenna device, a degree of increase in electromagnetic potential is greater than that of the antenna device 30 of FIG. 3. In the antenna device 30 of FIG. 3, the helical unit 34 is disposed at the end of the antenna device 30 and is lower than that of the antenna device 40 of FIG. 4. In the antenna device 40 of FIG. 4, the helical unit 44 is disposed close to the feeding unit F. Accordingly, the helical unit is designed to be close to the feeding unit F as much as possible. Thus, the antenna device 100 of FIG. 1 includes the first helical unit 122 adjacent to the feeding rod unit 112. The first helical unit 122 may be positioned for that when an entire length of the antenna device 100 is L, a distance between a beginning of the antenna device 100 and an end of the first helical unit 122 is less than L/2.

Figure 4:
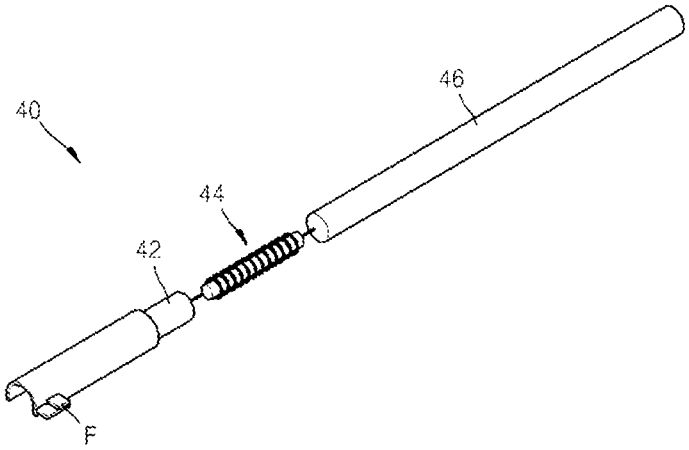
FIG. 4 is a schematic perspective view of an antenna device, according to another comparative example.

Meanwhile, the antenna device 40 of FIG. 4 includes a helical unit, which increases an electromagnetic potential throughout the antenna device 40, compared to the antenna device 20 of FIG. 2. The antenna device 200 of FIG. 2 does not include a helical unit. The distribution shows a pattern that is the same as a monopole-type antenna, having an electromagnetic field distribution of the antenna device 20 of FIG. 2. Accordingly, as shown in the antenna device 100 of FIG. 1, by including an additional helical unit, i.e., the second helical unit 124, the pattern of the electromagnetic field distribution is changed.

Figure 5:
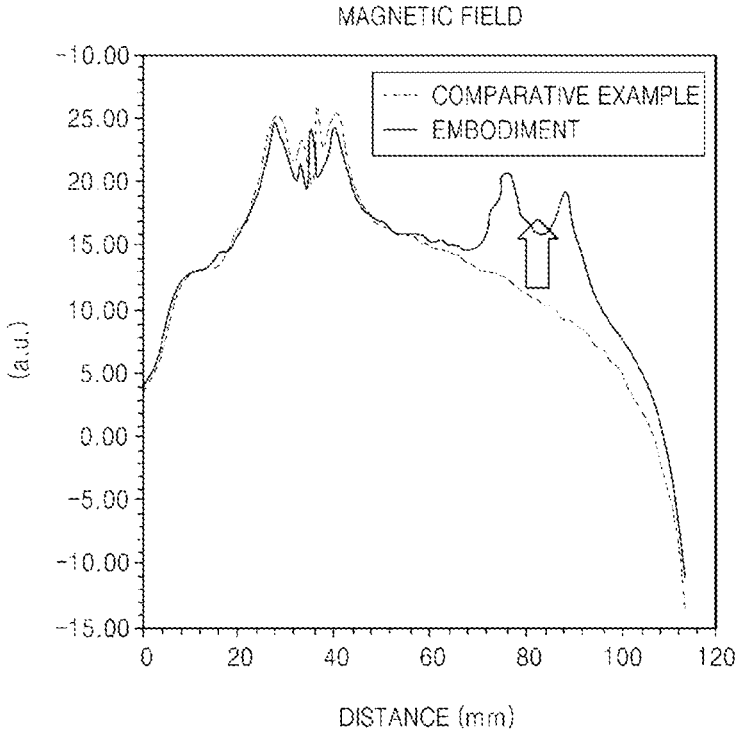
FIG. 5 is a graph showing distribution of magnetic fields formed by the antenna devices of FIGS. 1 and 4.
Figure 6:
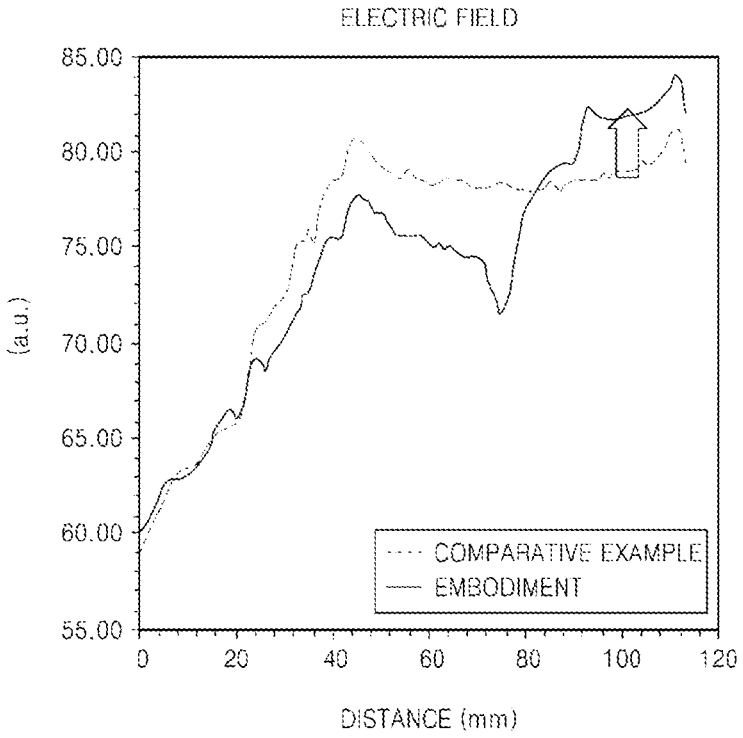
FIG. 6 is a graph showing distribution of electric fields formed by the antenna devices of FIGS. 1 and 4.

FIG. 5 is a graph showing a distribution of magnetic fields formed by the antenna devices 100 and 40 of FIGS. 1 and 4. FIG. 6 is a graph showing distribution of electric fields formed by the antenna devices 100 and 40 of FIGS. 1 and 4.

Referring to FIGS. 5 and 6, an electric field and a magnetic field formed by the antenna device 100 of FIG. 1, including the first helical unit 122 and the second helical unit 124, have a distribution that is closer to that of an electric field and a magnetic field formed by a ¼ wavelength monopole antenna, than the electric field and the magnetic field formed by the antenna device 40 of FIG. 4. The antenna device 40 of FIG. 4 includes only one helical unit 44.

In other words, in the antenna device 100 according to the embodiment, a strength of an electromagnetic field is increased throughout the antenna device 100 by the first helical unit 122. The first helical unit 122 is disposed as close to the feeding unit F as possible. An electromagnetic field distribution throughout the antenna device 100 is changed in a similar way to the ¼ wavelength monopole antenna by inducing a local reinforcement of an electromagnetic field by the second helical unit 124. The second helical unit 124 is disposed adjacent to the end of the antenna device 100.

The following table shows a result of a comparison between performance of the antenna device 100, according to the embodiment, and a ⅛ wavelength monopole antenna.

| | | ⅛ wavelength monopole antenna | Embodiment |
|---|---|---|---|
| Reception Sensitivity (dbM) | Ch. 8B | −52 | −52 |
| | Ch. 12B | −60 | −60 |

Figure 7:
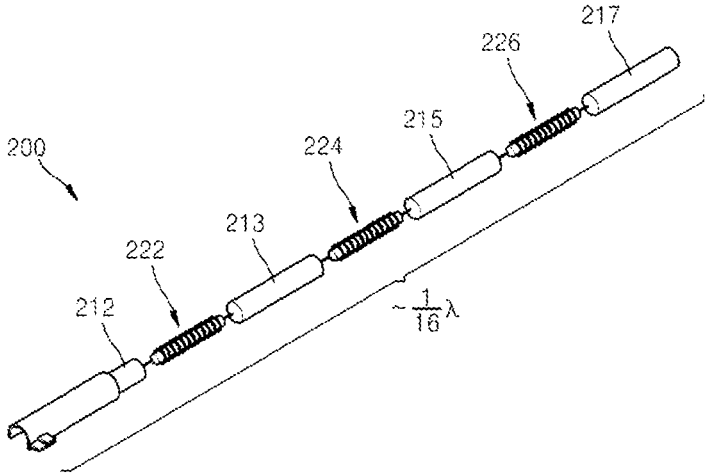
FIG. 7 is a schematic perspective view of an antenna device, according to another embodiment.

FIG. 7 is a schematic perspective view of an antenna device 200, according to another embodiment.

The antenna device 200 of the current embodiment in FIG. 7 includes two intermediate rod units interposed between a feeding rod unit 212 and an end rod unit 217. In other words, the two intermediate rod units include a first intermediate rod unit 213 and a second intermediate rod unit 215. The antenna device 200 of the current embodiment in FIG. 7 also includes three helical units. The three helical units include a first helical unit 222, a second helical unit 224, and a third helical unit 226.

An antenna device may employ a modified structure, in which a helical unit is disposed close to a feeding rod unit, an end is formed to have a rod shape, and a greater number of helical units and intermediate rod units are formed.

The above-described antenna devices 100 and 200 may be included in a wireless communication terminal. In this regard, protruding lengths of the antenna devices 100 and 200 are as short as λ/16. Therefore, the antenna devices 100 and 200 do not require a multistage folding structure for accommodating an antenna in a terminal. Thus, structures in which the antenna devices 100 and 200 are accommodated in the respective terminals may be simplified. For example, when the antenna devices 100 and 200 are employed in a wireless communication terminal for receiving DMB broadcasting, the protruding lengths of the antenna devices 100 and 200 may be about 9 cm based on a frequency band of 200 MHz. Protruding lengths of the antenna devices 100 and 200 may be shorter than a length of a major axis of a general portable wireless communication terminal, which is about 10 cm.

The above-described antenna devices 100 and 200 include an end having a rod shape as well as the components shown in FIGS. 1 and 2. The above-described antenna devices 100 and 200 may be modified into various shapes, including a plurality of helical units. Also, the antenna devices 100 and 200 may include an additional component. For example, an external double injection molded structure or a coating tube may be provided, which prevents external substances from entering the helical unit and prevents the helical unit from snapping or bending.

The antenna devices of the embodiment have the same performance as a related art antenna by including two or more coils that are properly disposed at an antenna rod. The antenna devices of the embodiments may generate an electromagnetic field distribution with a length of 1/16 wavelength, similar to that of a 1/4 wavelength monopole antenna.

In the antenna devices of the embodiment, protruding lengths are as short as 9 cm. Therefore, the antenna devices of the embodiment do not require a multistage folding structure for accommodating an antenna in a terminal. Thus, manufacturing costs are reduced due to simpler antenna structures and manufacturing processes.

The antenna devices of the embodiment may be employed in a radio communication terminal. A major axis of the radio communication terminal may be longer than the antenna device.

The antenna devices of the embodiment may obtain radio reception sensitivities that are equal at 1/2 length of a 1/8 wavelength monopole antenna.

While the embodiments have been shown and described with reference to exemplary embodiments thereof, it will be understood by those of ordinary skill in the art that various changes in form and details may be made therein without departing from the spirit and scope of the embodiment as defined by the following claims.

What is claimed is:

1. An antenna device comprising:

a feeding rod unit connected to a feeding unit, in which a radio signal is sent and received to the feeding unit;

an end rod unit, disposed at the end of the antenna device, and spaced apart from the feeding rod unit;

at least one intermediate rod unit, interposed between the feeding rod unit and the end rod unit;

a first helical unit, interposed between the feeding rod unit and the at least one intermediate rod unit; and a second helical unit, interposed between the intermediate rod unit and the end rod unit, wherein cross-section diameters of each rod shape included in the feeding rod unit, the at least one intermediate rod unit, and the end rod unit are the same, wherein each of the first and second helical units comprises a bobbin and a coil, surrounding the bobbin, wherein the bobbin is formed of a mixture of a magnetic material and plastic, the magnetic material having a relative permeability equal to or more than 4, and a permeability loss equal to or less than 0.5 at a frequency equal to or higher than 2 GHz, and wherein when a central wavelength of the radio signal to be sent and received is $\lambda$, an entire length of the antenna device is about $\lambda/16$.

2. The antenna device of claim 1, wherein the first helical unit is disposed adjacent to the feeding rod unit.

3. The antenna device of claim 1, wherein the antenna device is designed to send and receive a radio signal for digital multimedia broadcasting (DMB) or digital video broadcasting (DVB).

4. The antenna device of claim 1, wherein, when an entire length of the antenna device is L, a distance between a beginning of the antenna device and an end of the first helical unit is less than L/2.

5. The antenna device of claim 1, wherein the magnetic material comprises a compound represented by Equation 1 below, $$Ba_2Co_{2-x-y-z}Zn_xCu_yMn_zFe_{12}O_{22} \quad (1)$$

wherein, x is in a range between about 0.5 and about 0.9, y in a range between about 0 and about 0.4, z in a range between about 0 and about 0.4.

6. The antenna device of claim 1, wherein the plastic comprises any one of polycarbonate (PC), polyphenylene oxide (PPO), polycarbonate/acrylonitrile-butadiene-styrene (PC/ABS), or modified polyphenylene ether (mPPE).

7. A radio communication terminal comprising the antenna device of claim 1.

8. The radio communication terminal of claim 7, wherein a protruding length of a major axis of the radio communication terminal is longer than a protruding length of a major axis of the antenna device.

* * * * *